US007159673B2

(12) United States Patent
Van Dijk

(10) Patent No.: US 7,159,673 B2
(45) Date of Patent: Jan. 9, 2007

(54) DRILLING SYSTEM WITH EXPANDABLE SLEEVE

(75) Inventor: Robert Albertus Van Dijk, Arnhem (NL)

(73) Assignee: Shell Oil Company, Houston, TX (US)

( * ) Notice: Subject to any disclaimer, the term of this patent is extended or adjusted under 35 U.S.C. 154(b) by 208 days.

(21) Appl. No.: 10/475,920

(22) PCT Filed: Apr. 26, 2002

(86) PCT No.: PCT/EP02/04852

§ 371 (c)(1),
(2), (4) Date: Oct. 27, 2003

(87) PCT Pub. No.: WO02/088510

PCT Pub. Date: Nov. 7, 2002

(65) Prior Publication Data

US 2004/0144568 A1 Jul. 29, 2004

(30) Foreign Application Priority Data

Apr. 27, 2001 (EP) ..... 01303847

(51) Int. Cl.
*E21B 7/00* (2006.01)

(52) U.S. Cl. ..... 175/51; 175/72; 175/320

(58) Field of Classification Search ..... 175/51, 175/72, 320; 166/277, 380
See application file for complete search history.

(56) References Cited

U.S. PATENT DOCUMENTS

| | | | | |
|---|---|---|---|---|
| 341,327 | A | 5/1886 | Fay | |
| 1,380,182 | A | 5/1921 | Bigelow | |
| 1,981,525 | A | 11/1934 | Price | 166/4 |
| 3,912,026 | A * | 10/1975 | Crowe et al. | 175/297 |
| 4,187,061 | A * | 2/1980 | Jurgens | 418/48 |
| 5,366,012 | A | 11/1994 | Lohbeck | 166/277 |
| 5,613,557 | A | 3/1997 | Blount et al. | |
| 2001/0002626 | A1 | 6/2001 | Frank et al. | 175/57 |
| 2004/0173349 | A1 * | 9/2004 | Pointing | 166/241.6 |

FOREIGN PATENT DOCUMENTS

| | | |
|---|---|---|
| EP | 0360319 | 3/1990 |
| EP | 0899420 | 3/1999 |
| EP | 01097760 | 5/2001 |
| GB | 2344606 | 6/2000 |
| WO | 00/77431 | 12/2000 |

* cited by examiner

*Primary Examiner*—William Neuder

(57) ABSTRACT

A drilling system and method for drilling a borehole into an earth formation is provided. The drilling system has a drill string having a lower section provided with a sleeve which is radially expandable from a retracted mode in which the sleeve extends around the lower drill string section and is releasably connected thereto, to an expanded mode in which the sleeve is released from the lower drill string section and is expanded against the borehole wall. The drilling system further has a control means for selectively releasing the sleeve from the lower drill string section and expanding the sleeve against the borehole wall.

27 Claims, 2 Drawing Sheets

DRILLING SYSTEM WITH EXPANDABLE SLEEVE

FIELD OF THE INVENTION

The present invention relates to a drilling system for drilling a borehole into an earth formation.

BACKGROUND OF THE INVENTION

During drilling of the borehole drilling fluid is generally pumped through the drill string to the lower end of the string, from where the drilling fluid returns to surface via the annulus formed between the drill string and the borehole wall. The circulating drilling fluid transports the drill cuttings to surface, controls the wellbore pressure, and cools the drill bit.

A frequently encountered problem in the practice of drilling wellbores is leakage of drilling fluid from the borehole into the surrounding earth formation. Some leakage of fluid is generally considered allowable, however in many instances the amount of leakage is such that further drilling is not allowable without first taking corrective measures. Such heavy fluid losses can occur, for example, during drilling through depleted sandstone reservoirs and/or through unstable shales. It has been tried to stabilise the shales by applying a drilling fluid having a relatively high specific weight. However the weight of such heavy drilling fluid can be close to, or in excess of, the fracturing pressure of neighbouring sandstone formations. Conventional corrective measures include pumping of Lost Circulation Material (LCM) through the wellbore in order to plug the formation, pumping cement into the wellbore, or installing a casing or liner in the wellbore at the location of the fluid losses. The latter is the only feasible option in case the fluid losses are severe. Until now this has been done by retrieving the drill string and running the casing/liner into the borehole, which is a time consuming and costly procedure. Moreover, temporary measures to reduce the losses to acceptable levels have to be taken before retrieving the drill string from the borehole.

SUMMARY OF THE INVENTION

In accordance with one aspect of the invention there is provided a drilling system for drilling a borehole into an earth formation, the drilling system comprising a drill string having a lower section provided with a sleeve which is radially expandable from a retracted mode in which the sleeve extends around said lower drill string section and is releasably connected thereto, to an expanded mode in which the sleeve is released from the lower drill string section and is expanded against the borehole wall, the drilling system further comprising control means for selectively releasing the sleeve from the lower drill string section and expanding the sleeve against the borehole wall.

In accordance with another aspect of the invention there is provided a method of drilling a borehole into an earth formation using the drilling system of the invention, the method comprising:

lowering the drill string into the borehole and drilling a further section of the borehole while circulating a stream of drilling fluid through the borehole; and upon the occurrence of leakage of a selected amount of drilling fluid from the stream into the earth formation, operating the control means so as to release the sleeve from the lower drill string section and to expand the sleeve against the borehole wall.

When unacceptable drilling fluid losses are experienced during drilling of the borehole, the control means is operated so as to release the sleeve from the lower drill string section and to expand the sleeve against the borehole wall. In this manner a seal is created at the borehole wall which limits, or prevents, further outflow of drilling fluid into the earth formation without the need to first retrieve the drill string to surface.

The control means can, for example, comprise releasable retaining means for retaining the scrolled sleeve in the retracted mode.

Suitably the sleeve comprises a plate which, when in the retracted mode of the sleeve, is elastically deformed to form a scrolled sleeve. The plate is preferably free of holes. Alternatively the sleeve has the form of a solid tubular. To retain the sleeve in the scrolled arrangement, the releasable retaining means suitably comprises at least one tack weld arranged to weld overlapping sections of the scrolled sleeve to each other.

Advantageously the control means further comprises one of a hydraulic actuator and an explosive actuator provided with means for shearing off each tack weld upon activation of said actuator.

In order to retrieve the drill string from the borehole after the sleeve has been expanded against the borehole wall, the drill string is suitably provided with a drill bit capable of passing trough the sleeve when the sleeve is in the expanded mode thereof. For example, a variable gauge drill bit or a bi-centred drill bit can be applied.

BRIEF DESCRIPTION OF THE DRAWINGS

The invention will be described hereinafter in more detail and by way of example with reference to the accompanying drawings in which FIG. 1 schematically shows an embodiment of the drilling system of the invention including a scroll-type sleeve.

DETAILED DESCRIPTION OF THE INVENTION

Figure 1:
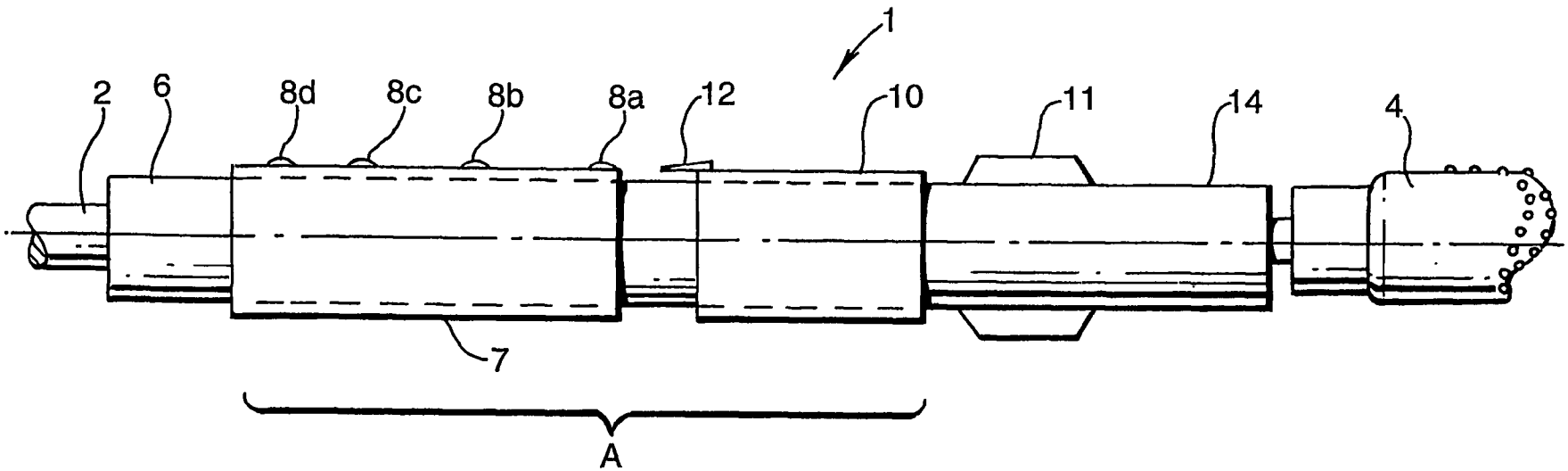

In FIG. 1 is shown a lower section of a drill string 1 including a drill pipe 2, a bi-centred drill bit 4 and a tubular drill collar 6 interconnected between the drill pipe 2 and the drill bit 4. A plate which is elastically deformed to form a scrolled sleeve 7, is arranged around the drill collar 6. The sleeve 7 is kept in the scrolled position by means of tack welds 8*a*, 8*b*, 8*c*, 8*d* having a strength such that, when tack weld 8*a* is sheared-off, the remaining tack welds 8*b*, 8*c*, 8*d* have insufficient strength to keep the sleeve 7 in the scrolled position. Thus, tack welds 8*b*, 8*c*, 8*d* are designed to shear-off by the action of the sleeve 7 to assume its pre-scrolled form. Axial sliding of the sleeve along the drill collar 6 is prevented by anti-slip pads (not shown) arranged between the sleeve 7 and the drill collar 6. The largest cross-sectional size of the bi-centred drill bit 4 is smaller than the drilling diameter of the drill bit 4 minus twice the thickness of the scrolled plate.

An annular piston 10 is arranged concentrically around the drill collar 6, adjacent the sleeve 7 and tack weld 8*a* thereof. The piston 10 is slideable in axial direction and is provided with a chisel 12 arranged to cut tack weld 8*a* upon axial movement of the piston 10 a selected stroke in the direction of the sleeve 7. A variable gauge stabiliser 11 is provided at the drill collar 6, between the sleeve 7 and the drill bit 4. A downhole motor 14 for driving the drill bit 4 is arranged between the stabiliser 12 and the drill bit 4.

In FIGS. 2A–D is shown a longitudinal section of the drill collar 6 during various stages of operation, whereby the sleeve 7 and the piston 10 are shown in more detail. Arrow 15 indicates the normal direction of flow of drilling fluid through the drill string 1 during drilling. The annular piston 10 includes a tubular member 16 arranged concentrically around the drill collar 6 whereby an annular space 18 is formed between the tubular member 16 and the drill collar 6. The tubular member 16 is provided with an end plate 20 sealed relative to the drill collar 6, and the drill collar 6 is provided with an annular seal ring 22 sealed relative to the tubular member 16. Fluid ports 24 are arranged in the wall of the drill collar to provide fluid communication between the inside 26 of the drill collar 6 and the annular space 18 during activation of the piston 10. During drilling the fluid ports 24 are closed off by an annular closure element 28 welded to the inner surface of the drill collar 6 by weld 30. A stop ring 32 is fixedly arranged within the drill collar 6 at a selected distance from the closure element 28 in the direction 34.

Figure 2A:
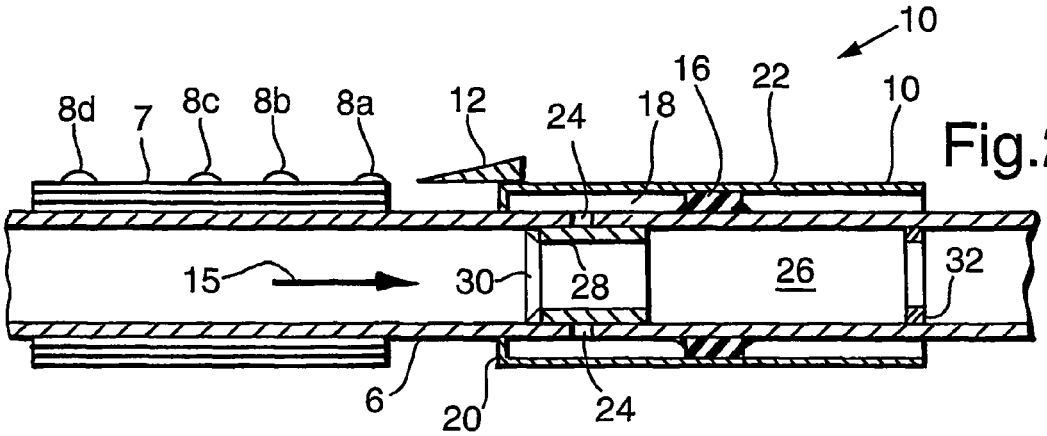
FIGS. 2A–2D schematically show detail A of FIG. 1 in longitudinal section and during various stages of operation of the drilling system of FIG. 1.
Figure 2B:
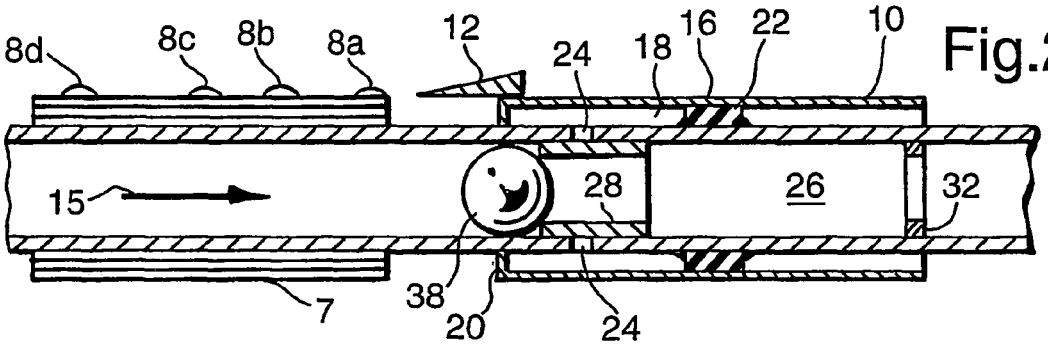

In FIGS. 2A–2B is additionally shown a ball 38 in the interior space 26 of the drill string 1, which ball 38 is of a diameter allowing the ball 38 to pass trough the drill string 1 and to seat on top of the closure element 28 so as to close off the interior space 26.

Figure 2C:
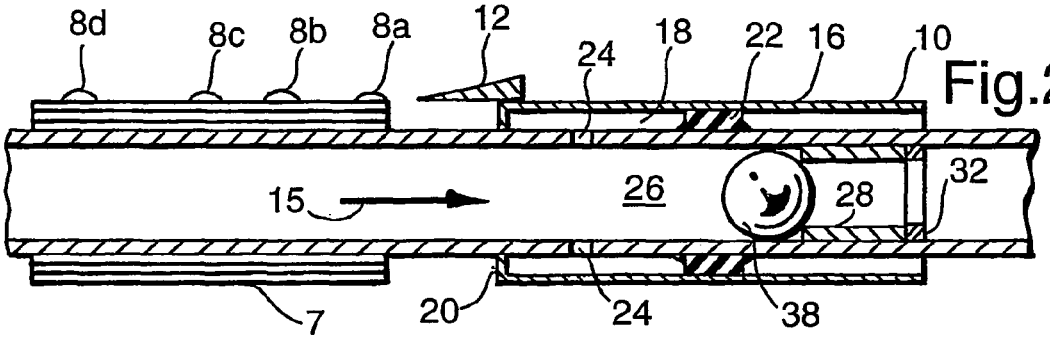
Figure 2D:
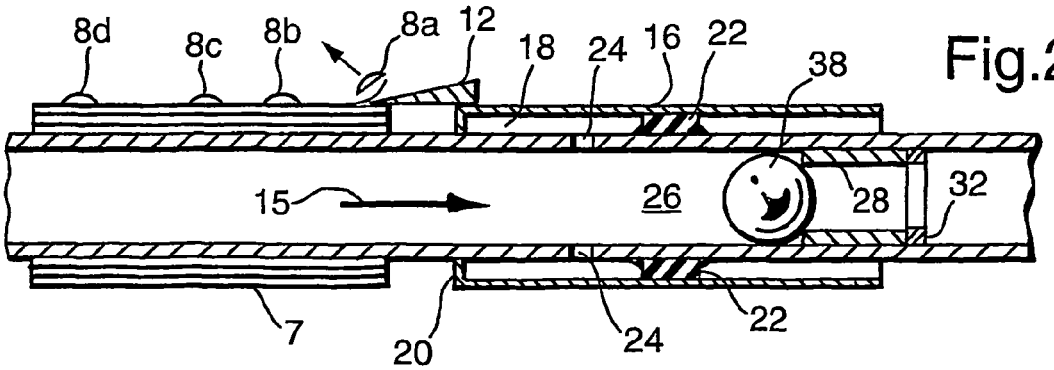

In FIGS. 2C and 2D the weld 30 has been sheared-off from the drill collar 6, and in FIG. 2D the tack weld 8*a* has been sheared-off from the sleeve 7.

During normal operation the drill string 1 is used to drill a borehole (not shown) into an earth formation, whereby drilling fluid is pumped through the interior space 26 of the drill string 1 to the drill bit 4. Under normal drilling circumstances most or all of the drilling fluid returns to surface through the annular space between the drilling string 1 and the borehole wall. However, under certain conditions a significant part of the drilling fluid does not return to surface due to fluid losses into the formation. This can happen, for example, during drilling into depleted sandstone formations or into formations in which large (natural) fractures are present. Such fluid losses are noticed at surface, and remedial action is taken in the following manner.

The ball 38 is pumped through the drill string 1 until the ball 38 seats on the weld closure element 28. Pumping of drilling fluid is continued thereby increasing the force exerted by the ball 38 to the closure element 28. When the exerted force exceeds the holding power of weld 30, the weld 30 shears off thereby allowing the ball to move the closure element 28 against the stop ring 32 and freeing the fluid ports 24. Drilling fluid thereby flows from the interior space 26 via the ports 24 into the annular space 18. Continued pumping of drilling fluid through the drill string 1 leads to an increased fluid pressure in the annular space 18 so that the annular piston 10 moves in the direction of the sleeve 7 until the chisel 12 cuts tack weld 8*a*. As a result the remaining tack welds 8*b*, 8*c*, 8*d* shear-off by virtue of the action of the sleeve 7 to assume its pre-scrolled shape, so that the sleeve 7 becomes detached from the drill collar 6 and expands to a larger diameter against the borehole wall. It is thereby achieved that the sleeve limits, or prevents, further outflow of drilling fluid from the borehole into the earth formation. Thus, there is no need to remove the drill string from the borehole prior to setting of the sleeve against the borehole wall. This is an important advantage since removal of the drill string from the borehole prior to setting of the sleeve could lead to an aggravation of the fluid leak-off, or even to a loss of control of fluid pressure in the borehole. When desired, the drill string 1 can be removed from the borehole through the previously expanded sleeve 7.

Instead of a bi-centred drill bit, an expandable drill bit, an under-reamer bit, or any drill bit which is capable of passing through the sleeve when expanded against the borehole wall, can be applied to drill the borehole. Furthermore, an under-gauge stabiliser can be used as an alternative to the variable gauge stabiliser.

The invention claimed is:

1. A drilling system for drilling a borehole into an earth formation, the drilling system comprising a drill string having a lower section provided with a sleeve which is radially expandable from a retracted mode in which the sleeve extends around said lower drill string section and is releasably connected thereto, to an expanded mode in which the sleeve is released from the lower drill string section and is expanded against the borehole wall while drilling, the drilling system further comprising a piston assembly for selectively releasing the sleeve from the lower drill string section and expanding the sleeve against the borehole wall while drilling.

2. The drilling system of claim 1, wherein the sleeve comprises a plate which, when in the retracted mode of the sleeve, is elastically deformed to form a scrolled sleeve.

3. The drilling system of claim 2, wherein the control means comprises releasable retaining means for retaining the scrolled sleeve in the retracted mode.

4. The drilling system of claim 3, wherein the releasable retaining means comprises at least one tack weld arranged to weld overlapping sections of the scrolled sleeve to each other.

5. The drilling system of claim 4, wherein the control means further comprises an actuator provided with means for shearing off each tack weld upon activation of said actuator.

6. The drilling system of claim 5, wherein the actuator is one of a hydraulic actuator and an explosive actuator.

7. The drilling system of claim 1, wherein the sleeve is selected from a solid tubular member and a slotted tubular member.

8. The drilling system of claim 1, wherein the drill string is further provided with a drill bit capable of passing through the sleeve when the sleeve is in the expanded mode thereof.

9. The drilling system of claim 8, wherein the drill bit is selected from a bi-centred drill bit, an expandable drill bit and an underreamer drill bit.

10. The drilling system claim 1, wherein said lower section of the drill string is formed by a Bottom Hole Assembly of the drill string, the Bottom Hole Assembly including one or more drill collars.

11. A method of drilling a borehole into an earth formation using the drilling system of claim 1 the method comprising:

lowering the drill string into the borehole and drilling a further section of the borehole while circulating a stream of drilling fluid through the borehole; and upon the occurrence of leakage of a selected amount of drilling fluid from the stream into the earth formation, operating the hydraulic actuator so as to release the sleeve from the lower drill string section and to expand the sleeve against the borehole wall.

12. The drilling system of claim 2, wherein the sleeve is selected from a solid tubular member and a slotted tubular member.

13. The drilling system of claim 3, wherein the sleeve is selected from a solid tubular member and a slotted tubular member.

14. The drilling system of claim 4, wherein the sleeve is selected from a solid tubular member and a slotted tubular member.

15. The drilling system of claim 5, wherein the sleeve is selected from a solid tubular member and a slotted tubular member.

16. The drilling system of claim 6, wherein the sleeve is selected from a solid tubular member and a slotted tubular member.

17. The drilling system of claim 2, wherein the drill string is further provided with a drill bit capable of passing through the sleeve when the sleeve is in the expanded mode thereof.

18. The drilling system of claim 3, wherein the drill string is further provided with a drill bit capable of passing trough the sleeve when the sleeve is in the expanded mode thereof.

19. The drilling system of claim 4, wherein the drill string is further provided with a drill bit capable of passing trough the sleeve when the sleeve is in the expanded mode thereof.

20. The drilling system of claim 5, wherein the drill string is further provided with a drill bit capable of passing trough the sleeve when the sleeve is in the expanded mode thereof.

21. The drilling system of claim 6, wherein the drill string is further provided with a drill bit capable of passing trough the sleeve when the sleeve is in the expanded mode thereof.

22. The drilling system of claim 7, wherein the drill string is further provided with a drill bit capable of passing trough the sleeve when the sleeve is in the expanded mode thereof.

23. A method of deforming a sleeve comprising:

providing a drill pipe;

providing a drill collar arranged concentrically around the drill pipe;

elastically deforming the sleeve around the drill collar, causing the sleeve to assume a scrolled form;

placing the sleeve around the drill pipe;

securing the sleeve in the scrolled form with a securing means; and releasing the securing means to allow the sleeve to expand; wherein releasing comprises:

arranging a piston assembly concentrically around the drill collar adjacent to the sleeve wherein the piston assembly comprises a piston, a chisel, and a tubular member arranged concentrically around the drill collar to form an annular space;

activating the piston to move towards the sleeve; and allowing the chisel to cut at least one of the securing means.

24. The method of claim 23 wherein the securing is performed by a plurality of tack welds.

25. The method of claim 24 wherein activating the piston comprises increasing the pressure in the annular space.

26. The method of claim 25 wherein increasing the pressure in the annular space comprises:

providing the drill collar with a plurality of fluid ports that provide fluid communication between the inside of the drill collar and the annular space;

closing off the fluid ports with a closure element;

pumping drilling fluid through the inside of the drill collar; freeing the fluid ports; and allowing drilling fluid to flow from the inside of the drill collar to the annular space via the fluid ports.

27. The method of claim 26 wherein freeing the fluid ports comprises pumping a ball through the drill pipe and allowing the ball to exert a force on the closure element.

* * * * *